US009159330B2

(12) United States Patent
Takada

(10) Patent No.: US 9,159,330 B2
(45) Date of Patent: Oct. 13, 2015

(54) RATE CONTROLLER, RATE CONTROL METHOD, AND RATE CONTROL PROGRAM

(75) Inventor: Yousuke Takada, Kobe (JP)

(73) Assignee: GVBB Holdings S.A.R.L., Luxembourg (LU)

( * ) Notice: Subject to any disclaimer, the term of this patent is extended or adjusted under 35 U.S.C. 154(b) by 821 days.

(21) Appl. No.: 13/391,264

(22) PCT Filed: Aug. 20, 2009

(86) PCT No.: PCT/JP2009/003966

§ 371 (c)(1),
(2), (4) Date: Jun. 15, 2012

(87) PCT Pub. No.: WO2011/021238

PCT Pub. Date: Feb. 24, 2011

(65) Prior Publication Data

US 2012/0263312 A1 Oct. 18, 2012

(51) Int. Cl.
*H04R 5/00* (2006.01)
*G10L 19/02* (2013.01)

(52) U.S. Cl.
CPC ..... *G10L 19/0204* (2013.01)

(58) Field of Classification Search
CPC ..... G10K 11/175; G10L 19/24; G10L 19/032
USPC ..... 381/23, 73.1; 704/500–501, 504, 230, 704/200.1
See application file for complete search history.

(56) References Cited

U.S. PATENT DOCUMENTS 6,122,618 A * 9/2000 Park ..... 704/500
6,295,009 B1 * 9/2001 Goto ..... 341/50
2005/0144017 A1 * 6/2005 Kabi et al. ..... 704/500
2007/0162277 A1 * 7/2007 Kurniawati et al. ..... 704/200.1
2008/0040120 A1 * 2/2008 Kurniawati et al. ..... 704/500

FOREIGN PATENT DOCUMENTS

| | | |
|---|---|---|
| JP | 06-051795 | 2/1994 |
| JP | 07-210195 | 8/1995 |
| JP | 10-136362 | 5/1998 |
| JP | 10-207489 | 8/1998 |
| JP | 2000-501846 | 2/2000 |
| JP | 2004-172770 | 6/2004 |

OTHER PUBLICATIONS

International Search Report for International Application No. PCT/JP2009/003966, mailed Oct. 27, 2009, 2 pages.
International Preliminary Report on Patentability dated Mar. 13, 2012 and Written Opinion dated Oct. 27, 2009, regarding PCT/JP2009/003966.
Notice of Reasons for Rejection dated Dec. 3, 2013 regarding Japan Patent Application No. JP 2011-527482.

* cited by examiner

*Primary Examiner* — Disler Paul
(74) *Attorney, Agent, or Firm* — Arent Fox LLP

(57) ABSTRACT

In an audio encoding system that divides frames generated from input signals into multiple scale factor bands and that encodes each of the scale factor bands by using a scale factor, the invention provides a rate control apparatus that performs rate control based on an NMR, the rate control apparatus comprising an NMR determination unit that determines an NMR that does not exceed a target rate by a binary search; and a scale factor determination unit that determines, by a binary search, the largest scale factor corresponding to the NMR determined by the NMR determination unit and a rate. Each time the NMR determination unit selects an NMR candidate value that acts as a candidate when the NMR determination unit searches for an NMR by a binary search, the scale factor determination unit determines the scale factor corresponding to the NMR candidate value.

20 Claims, 18 Drawing Sheets

```
outer_loop (i', r^target)
{
    (i^west, i^east, r^west, r^east) ← outer_loop_first(i', r^target, ⌈NMR^max/ΔNMR⌉, ⌊NMR^min/ΔNMR⌋)
    if (i^west < i^east){
        return outer_loop_second(i^west, i^east, r^west, r^east, r^target)
    } else {
        if (r^west < 0){
            return (i^east, r^east)
        } else {
            return (I^∞, inner_loop(I^∞))
        }
    }
}
```

*Fig. 11*

```
outer_loop_first(i', r^target, i^max, i^min)
{
    (i^west, r^west) ← (i^max + 1, -1)
    (i^east, r^east) ← (i^min - 1, -1)
    i' ← max(i^min, min(i^max, i'))
    (i, r) ← (i', inner_loop(i'))
    for (k ← max(1, ⌊(r - r^target)DBR/ΔNMR⌋); k ← ⌈1.5k⌉){
        if (r > r^target){
            (i^west, r^west) ← (i, r)
            i' ← min(i^max, i + k)
        } else {
            (i^east, r^east) ← (i, r)
            i' ← max(i^min, i - k)
        }
        if (i^west < i^east) break
        if (i = i') break
        (i, r) ← (i', inner_loop(i'))
    }
    return (i^west, i^east, r^west, r^east)
}
```

*Fig. 12*

```
outer_loop_second (i^west, i^east, r^west, r^east, r^target)
{
    while (i^east − i^west > 1){
        i' ← ⌊(i^east + i^west)/2⌋
        (i, r) ← (i', inner_loop(i'))
        if (r > r^target){
            (i^west, r^west) ← (i, r)
        } else {
            (i^east, r^east) ← (i, r)
        }
    }
    return (i^east, r^east)
}
```

*Fig. 13*

```
inner_loop (i)
{
    if (i ≥ I^∞){
        return simulate_zero()
    } else {
        for (j = 0; j < N_SFBs; j ← j + 1){
            sf_j ← allocate_noise(& ROOT_j, SFB_j, SF_j^west, SF_j^east, NMR_j^west, NMR_j^east, iΔNMR)
        }
        return simulate(sf)
    }
}
```

*Fig. 14*

```
allocate_noise (tt, sfb, sf^west, sf^east, nmr^west, nmr^east, nmr^target)
{
    if (nmr^east ≤ nmr^target){
        return sf^east
    } else if (nmr^target ≤ nmr^west){
        return sf^west
    } else {
        while (sf^east − sf^west > 1){
            (sf, t) ← (⌊(sf^east + sf^west)/2⌋ * tt)
            if (t = φ) * tt ← t ← new_node(sfb, sf)
            if (t : nmr > nmr^target){
                (sf^east, tt) ← (sf, & (t : node^west))
            } else {
                (sf^west, tt) ← (sf, & (t : node^east))
            }
        }
        return sf^west
    }
}
```

*Fig. 15*

RATE CONTROLLER, RATE CONTROL METHOD, AND RATE CONTROL PROGRAM

CROSS-REFERENCE TO RELATED APPLICATION

This application is a United States National Stage Application under 37 CFR §371 of International Patent Application No. PCT/JP2009/03966, filed Aug. 20, 2009, which is incorporated by reference into this application as is fully set forth herein.

TECHNICAL FIELD

This invention is directed to a rate control apparatus, rate control method, and rate control apparatus that optimally control noise energy and bit rates.

BACKGROUND TECHNOLOGY

Conventionally, the goal of rate control in audio encoding, such as Advanced Audio Coding (AAC), has been to quantize a prescribed number of data samples (hereinafter referred to as "audio samples" obtained from audio signals, for example, frequency spectra obtained by time frequency transform by Modified Discrete Cosine Transform (MCDT), so that the quantized noise energy will not exceed the mask energy obtained by an audio psychological model. Simultaneously, the amount of coding needs to be controlled so that it will not exceed a fixed level, or the average bit rate, for example. ACC, by means of a scheme called a bit reserver, permits controls to maintain a fixed bit rate in long term by changing the bit rate in short term while maintaining a fixed level of quality to the maximum extent possible.

An issue in rate control by audio encoding is how to satisfy, or violate, the twin conflicting goals of ensuring that the quantized noise energy does not exceed the mask energy required by the audio psychological model and controlling the amount of encoding to below a fixed level. A standardized "optimal" rate control method does not exist. As an example, we explain the conventionally employed method of using a double loop, described in the Informative Part of the AAC Standards document. In the explanation that follows, audio codec is assumed to be AAC.

The quantization in ACC is performed according to the following procedure: Before band-by-band quantization, to shape the noise according to the amplitude, the frequency spectrum is transformed non-linearly. The non-linearly transformed frequency spectrum is divided into scale factor bands for which the range of masking effect is simulated, and the quantization is controlled on a band-by-band basis. The quantization of a scale factor band is referred to as a scale factor. The scale factor is controlled by a quantization scale that changes in increments of approximately 1.5 dB steps. The scale factors themselves are DPCM (Differential Pulse Code Modulation) encoded. The quantized value of each band is controlled to a fixed range ([−8191, +8191]) and it is entropy-encoded. According to the statistical characteristics of the distribution of quantized values, an optimal table can be selected from predetermined tables of entropy encoding. With respect to the band in which all quantization values are 0, the entropy coding of scale factors and quantization values can be omitted, thus saving codes.

In the conventional method, a double loop consisting of inner and outer loops is employed to determine a scale factor so that the amount of encoding will be less than the average bit rate. FIG. 16 shows a flowchart depicting an inner loop (rate control processing) according to the conventional method; FIG. 17 provides a flowchart explaining an outer loop (distortion control processing) according to the conventional method.

We now turn to the inner loop according to the conventional method, in reference to FIG. 16. First, the amount of encoding is calculated using the scale factor that is given for each band (S101). Next, a determination of whether the amount of encoding is less than the average bit rate is made (S102). If it is determined that the amount of encoding is greater than the average bit rate, the scale factors for all bands are increased (S103), and the processing returns to S101. If the amount of encoding is judged to be less than the average bit rate, the processing ends.

We now explain the outer loop according to the conventional method, in reference to FIG. 17. First, the scale factor is initialized (S111). For example, the scale factor is initialized so that it is at a minimum, that is, it is quantized to the finest value. Next, calling the inner loop (S112), the noise energy is calculated for each band (S113). Specifically, an inverse-quantized spectrum is determined and noise energy is calculated for each band. The method involving the determination of noise by inverse quantization is referred to as Analysis by Synthesis (AbS). Further, for a band that is greater than the mask energy determined by auditory psychoanalysis, the scale factor is reduced, and the quantization is made finer (S114). If the ratio between noise energy and mask energy is designated as NMR (Noise-to-Mask Ratio), the condition that minimizes the scale factor will be NMR>1.

A determination is made as to whether the scale factors for all bands have been changed (S115). If it is determined that changes have not been made, a determination is made as to whether scale factors for any bands have not been changed (S116). If it is determined in Step S116 that there is a band for which the scale factor has been changed, the processing returns to Step S112. If it is determined in Step S115 that scale factors were changed for all bands or if it is determined in Step S116 that scale factors for any bands have not been changed, the scale factors are restored (S117).

PRIOR ART REFERENCES

Patent References

Patent Reference 1: Laid-Open Patent Disclosure H10-136362

Non-Patent References

Non-Patent Reference 1: M. Bosi and R. E. Goldberg. "Introduction to Digital Audio Coding and Standards." Kluwer Academic Publishers. 2003.

Non-Patent Reference 2: ISO/IEC 13818-7: 2006. "Information Technology—Generic Coding of Moving Pictures and Associated Audio—Part 7: Advanced Audio Coding (AAC)." 2006.

SUMMARY OF THE INVENTION

The conventional method contains the problem that there is no guarantee that the loop converges. Further, even in situations where the loop converges, if, for example, the amount of encoding is inadequate, the condition cannot be found in which quantization is performed in a manner that keeps the NMR constant so that noise is as inconspicuous as possible even when the requirements imposed by an auditory psychological model are not satisfied, that is, an optimal solution cannot be found, which is a problem. And the conventional method also suffers from the problem in that, since rate control is performed so that the amount of encoding is controlled to a predetermined level, bit reservers cannot be used effectively.

An objective of the present invention, accomplished in view of the conventional technology described above, is to provide a rate control apparatus, rate control method, and rate control program that optimally control the bit rates based on an NMR.

According to Aspect 1 of the present invention, in an audio encoding system that divides frames generated from input signals into multiple scale factor bands and that encodes each of said multiple scale factor bands by using a scale factor, this invention provides a rate control apparatus that performs rate controls based upon an NMR (Noise-to-Mask Ratio), which is the ratio of noise energy to mask energy based on a predetermined auditory psychological model, wherein the rate control apparatus is an apparatus including an NMR determination unit that determines, by a binary search, an NMR that does not exceed a target rate; and a scale factor determination unit that determines, for each scale factor band and by a binary search, the maximum scale factor that corresponds to the NMR that was determined by said NMR determination unit; wherein each time said NMR determination unit selects an NMR candidate value that serves as a candidate when the NMR is searched for by a binary search, said the scale factor determination unit determines a scale factor and a rate with respect to said NMR candidate value; and wherein said NMR determination unit determines as the optimal NMR the smallest NMR that does not exceed a target rate, based upon the difference between the rate with respect to said NMR candidate value that was calculated based on the scale factor determined by said scale factor determination unit and said target rate. By such a constitution, the rate control apparatus of the present invention can satisfy a target rate and simultaneously maintain a fixed NMR to the maximum possible extent, that is, it can maintain a constant level of quality.

Further, in the rate control apparatus of the present invention, said NMR determination unit can start a binary search from an interval that is defined by a predicted NMR value and an NMR candidate value that is selected such that rates corresponding to the rates with respect to said predicted NMR value include said target rate between them. In addition, said scale factor determination unit sets, for each scale factor band, the smallest scale factor among the scale factors whose absolute quantization value of frequency spectra does not exceed a previously established maximum value as a west scale factor; and calculates, as an east scale factor, the smallest scale factor for which the quantization values of frequency spectra are all zero; and the NMR determination unit can start a binary search for the maximum scale factor corresponding to the NMR candidate value that was selected by said NMR determination unit, from an interval that is demarked by said west scale factor and said east scale factor. By such a constitution, the rate control apparatus of the present invention can effectively reduce the interval over which a binary search is performed.

Further, in the rate control apparatus of the present invention, said scale factor determination unit calculates the maximum and minimum NMR based upon the west scale factor and the east scale factor that were calculated by said scale factor determination unit; and said scale factor determination unit can determine said west scale factor as a scale factor with respect to said NMR candidate value if said NMR candidate value is less than the minimum NMR, and can determine said east scale factor as a scale factor with respect to said NMR candidate value if said NMR candidate value is greater than the maximum NMR.

The NMR of a scale factor can be calculated as the ratio of the noise energy associated with quantization to the mask energy. The mask energy of a scale factor is energy that masks a signal that has signal energy that does not exceed it, that is, energy that cannot be identified by a person when he or she hears it. By such a constitution, the rate control apparatus of the present invention can provide efficient encoding so that no bits are assigned to audio signal unidentifiable by the human auditory sense and so that bits are adaptively assigned to the signal components in the hearable region.

The rate control apparatus of the present invention can also be constructed so that it comprises a memory unit that stores the process of a binary search that is performed by said scale factor determination unit and so that said scale factor determination unit performs a binary search based upon the binary search process that is stored in said memory unit.

By such a constitution, the rate control apparatus of the present invention eliminates the need for recalculation, during the execution of a binary search by the scale factor determination unit, by storing the process thereof in the memory unit, thereby achieving efficient processing.

Further, in the rate control apparatus of the present invention, said target rate can be variable within a predetermined range. If the target rate is provided with some latitude, the NMR determination unit first calculates an amount of encoding by using a predicted NMR value, and can terminate rate control if the amount of encoding is within the target rate, without performing a binary search. As a predicted NMR value, the NMR used in a previous frame may be employed, for example. By such a constitution, the rate control apparatus of the present invention can provide feedback control on predicted NMR values so that the amount of encoding for the next frame can be increased or reduced according to the extent of deviation from the target value for the bit reserver, or deviation from 80%, for example, of the maximum value of the bit reserver. By varying the rate in the short term, in the long term it is possible to perform encoding at a fixed rate while maintaining a constant level of quality for the NMR or the signal.

Further, said NMR determination unit can be constructed so that it updates the predicted NMR value each time said frame is encoded. The predicted NMR value, for example, can be revised each time a frame is encoded and in response to the fluctuations of the bit reserver from a target value. Because the scale factor is determined based on a more or less fixed predicted NMR value, control can be performed so that any short-term rate fluctuations are absorbed by the bit reserver, while keeping quality constant to the maximum possible extent and so that a fixed rate is maintained in the long term. In this manner, it is possible to utilize the bit reserver effectively, and more adaptive rate control can be accomplished.

According to Aspect 2 of the present invention, in an audio encoding method that divides frames generated from input signals into multiple scale factor bands and that encodes each of said multiple scale factor bands by using a scale factor, this invention provides a rate control method that performs rate controls based upon an NMR, which is the ratio of noise energy to mask energy based on a predetermined auditory psychological model, wherein the rate control method comprises an NMR determination step that determines, by a binary search, an NMR that does not exceed a target rate; a scale factor determination step that determines, for each scale factor band and by a binary search, the maximum scale factor that corresponds to the NMR that was determined in said NMR determination step; and an evaluation step that determines whether said NMR candidate value is the smallest NMR that that does not exceed the target rate by evaluating the difference between the rate on said NMR candidate value calculated based on the scale factor determined in said scale factor determination step and said target rate; wherein each time an NMR candidate value is selected that acts as a candidate during the binary search for an NMR in said NMR determination step, said scale factor determination step determines a scale factor on said NMR candidate value; wherein if it is determined in said evaluation step that said NMR candidate value is the smallest NMR that does not exceed the target rate, said NMR candidate value is determined as the optimal NMR; and wherein it is determined in said evaluation step that said NMR candidate value is not the smallest NMR that does not exceed the target rate, the steps from said NMR determination step to said evaluation step are repeated.

By such a constitution, the rate control method of the present invention can satisfy a target rate and simultaneously maintain a fixed NMR, that is, quality, to the maximum possible extent.

According to Aspect 3 of the present invention, in an audio encoding method that divides frames generated from input signals into multiple scale factor bands and that encodes each of said multiple scale factor bands by using a scale factor, this invention provides a rate control program that causes the computer to execute rate control processing that performs rate controls based on an NMR, which is the ratio of noise energy to mask energy based on a predetermined auditory psychological model; wherein said rate control processing comprises an NMR determination step that determines, by a binary search, an NMR that does not exceed a target rate; a scale factor determination step that determines, for each scale factor band and by a binary search, the maximum scale factor that corresponds to the NMR that was determined by said NMR determination step, and a rate; and an evaluation step that evaluates the difference between the rate on said NMR candidate value calculated based on a scale factor determined in said scale factor determination step and said target rate, and determines whether said NMR candidate value is the smallest NMR that that does not exceed the target rate; wherein each time an NMR candidate value is selected that acts as a candidate during the binary search for an NMR in said NMR determination step, in said scale factor determination step a scale factor is determined on said NMR candidate value; wherein if it is determined in said evaluation step that said NMR candidate value is the smallest NMR that does not exceed the target rate, said NMR candidate value is determined as the optimal NMR; and wherein it is determined in said evaluation step that said NMR candidate value is not the smallest NMR that does not exceed the target rate, the steps from said NMR determination step to said evaluation step are repeated. In the rate control program, said NMR determination step and said evaluation step constitute an outer loop, and the computer is caused to execute said scale factor determination step and an inner loop. By such a constitution, the rate control program of the present invention can cause the computer to execute rate controls so that a target rate is met and simultaneously a fixed NMR, that is, quality, is maintained to the maximum possible extent.

BRIEF DESCRIPTION OF THE DRAWINGS

FIG. 11 Shows pseudo code for an outer loop.

FIG. 12 Shows stage 1 pseudo code for an outer loop.

FIG. 13 Shows stage 2 pseudo code for an outer loop.

FIG. 14 Shows pseudo code for an inner loop.

FIG. 15 Shows pseudo code that determines a scale factor by a binary search.

DETAILED DESCRIPTION OF THE INVENTION

The text below provides detailed descriptions of specific modes of embodiment of the present invention with references to drawings.

First, we explain the underlying principles of the rate control of the present invention.

<Underlying Principles of the Rate Control of the Present Invention>

Figure 1:
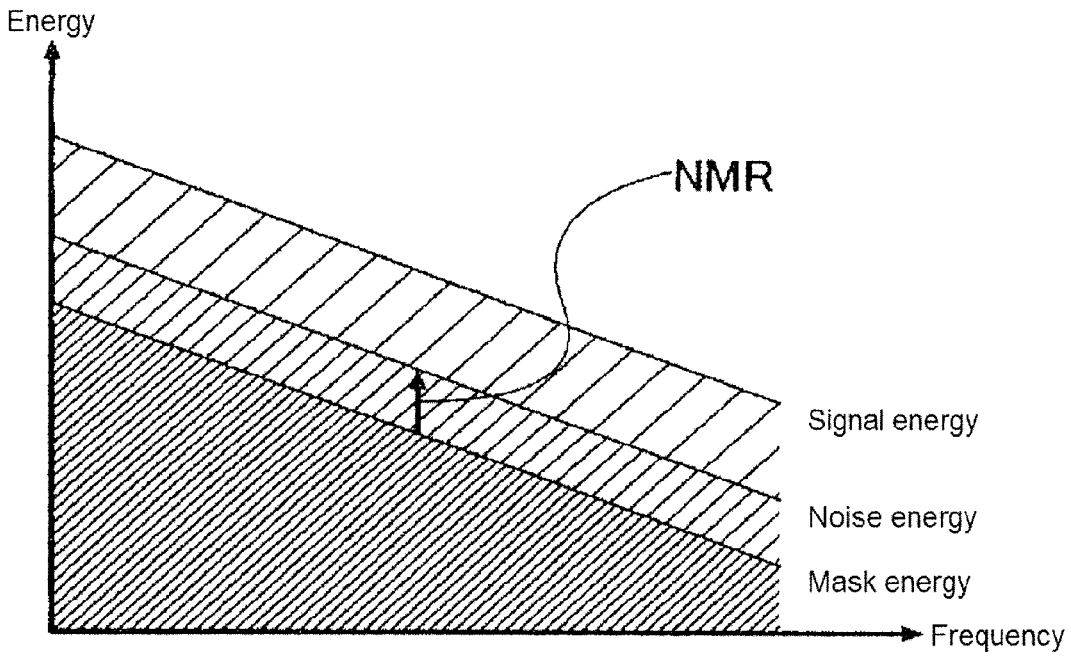
FIG. 1 Shows an example of the relationship between signal energy, noise energy, and mask energy.

FIG. 1 shows an example of the relationship between signal energy, noise energy, and mask energy. In this Specification, unless otherwise noted, the ratio is defined as NMR, and we use its decibel value, $NMR_{dB}$. $NMR_{dB}$ is defined as follows:

$$NMR_{dB}=10\log_{10}NMR \quad \text{[Eq. 1]}$$

As shown in FIG. 1, if NMR is positive, noise is not masked. On the other hand, if NMR is negative, noise is masked. It is rare that a typical bit rate completely satisfies the requirements imposed by an auditory psychological model; consequently, rates are frequently controlled through the use of a positive NMR.

Figure 2:
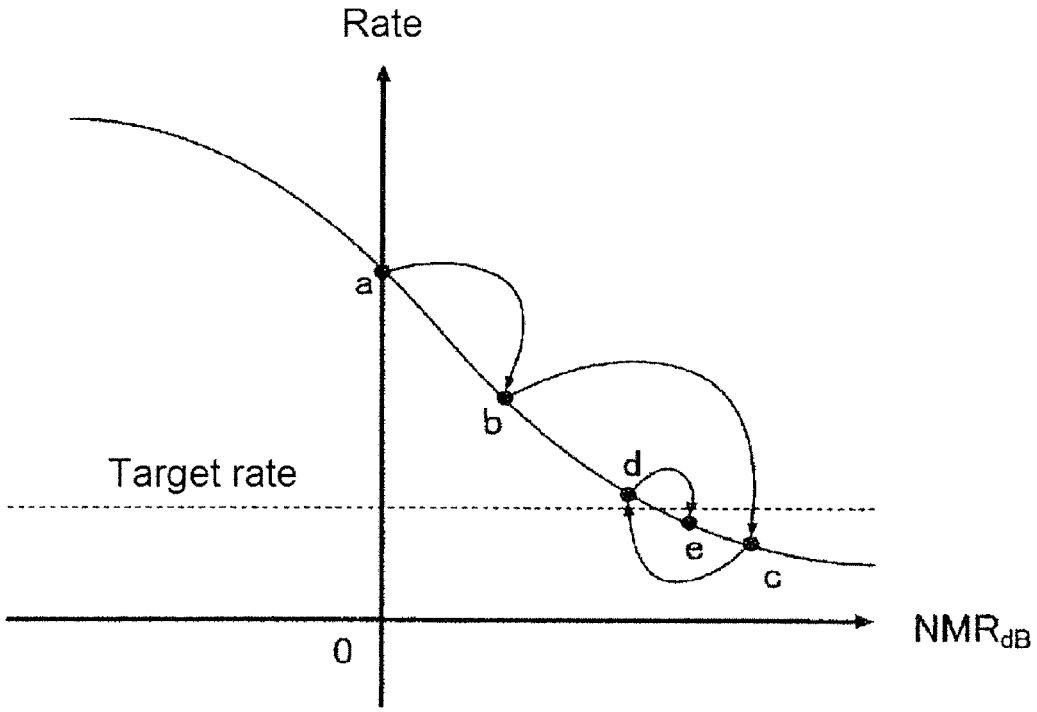
FIG. 2 Shows the relationship between a rate and an NMR.

FIG. 2 shows the relationship between rates and NMRs. While there is a negative correlation between rates, that is, coding amounts, and NMRs, the correlation is not necessarily monotonic. Neither a rate, that is, the amount of coding, nor NMR can be controlled directly; they are controlled through a scale factor. For this reason, rate control can be performed by using a double loop.

In this outer loop, a minimum NMR that does not exceed the target rate is searched for.

The search consists of two stages. In the first stage, far-away NMR candidate values are tried until the target rate is exceeded. In the example in FIG. 2, NMR candidate values a, b, and c are tried, yielding an NMR interval (b, c) that includes the target rate between the end points. In addition, the initial candidate value a of NMR can be made equal to a predicted value of NMR. In the example in FIG. 2, the predicted value is set to 0. The interval for NMR candidate values can be increased gradually until the target rate is leapfrogged. For a predicted value of NMR, the NMR value that was used in the encoding of the previous frame, for example, or a value calculated based upon the NMR used in the encoding of the previous frame may be used.

In the second stage, a binary search is performed from the interval (b, c), a rate is determined with respect to a new candidate values d, e, the interval is reduced, ((b, c)→(d, c)→(d, e)), and the smallest NMR that does not exceed the target rate is determined.

Target rates can be provided with some latitude. The rate can be controlled by setting the minimum target encoding amount to 50%, for example, of the average encoding amount, and by setting the maximum target encoding amount to 200% of the average encoding amount, so that the encoding amount can fit in the range between the minimum target encoding amount and the maximum target encoding amount. Local encoding amounts, that is, rate fluctuations, in the range between the minimum target encoding amount and the maximum target encoding amount can be absorbed by using a bit reserver.

Further, the predicted values of an NMR can be updated each time a frame is encoded. For example the predicted values of NMR can be subjected to feedback control so that the encoding amount of the next frame can be increased or decreased according to the extent of deviation from a target rate of the bit reserver target value, or 80% of the maximum amount of exclusive use of the bit reserver, for example. Thus, by allowing the rate to fluctuate in the short term to maintain the NMR or quality at a constant level to the maximum possible extent, in the long term encoding can be performed at a fixed rate. Such a rate control method is referred to as ABR.

Figure 3:
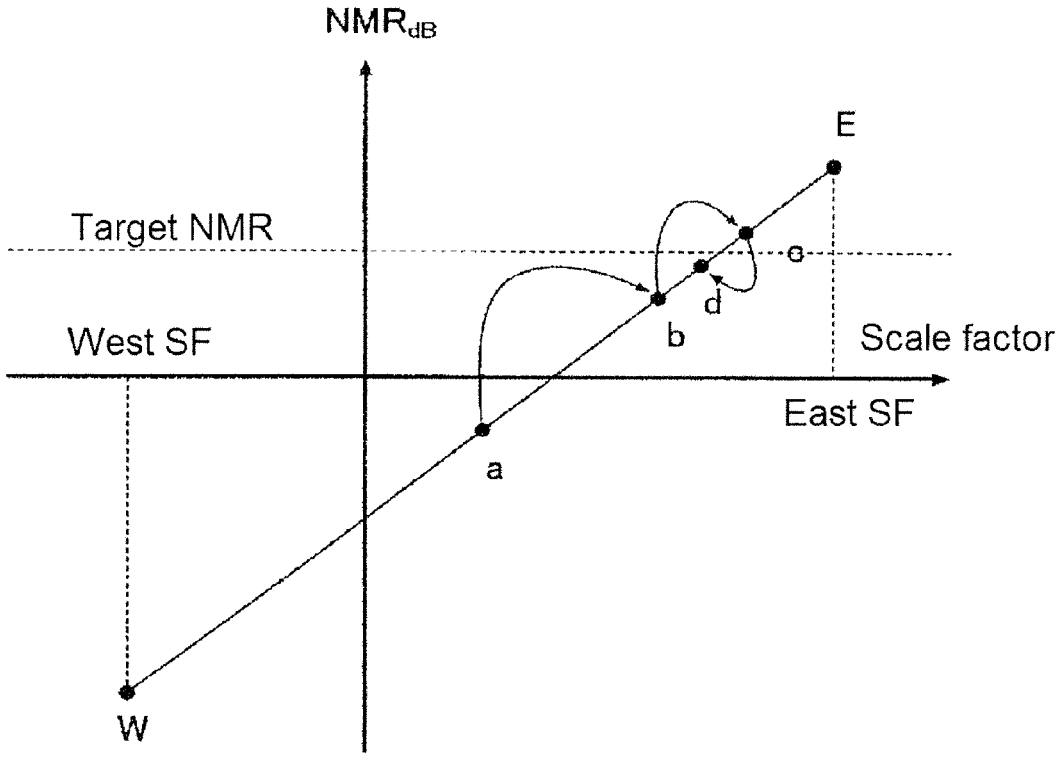
FIG. 3 Shows an example of the relationship between a scale factor and an NMR.

FIG. 3 shows an example of the relationship between the scale factor (SF) and the NMR. Although a positive correlation exists between the scale factor and the NMR as shown in FIG. 3, it is not necessarily a monotonic increase. Here, in a given band, of the scale factors for which the quantization values of frequency spectra are all 0, the smallest scale factor is referred to as an east scale factor (east SF). In FIG. 3, point E represents such a scale factor. In this case, the NMR assumes a maximum value. The NMR can be determined by means of AbS which was described above.

Also, in a given band, the smallest scale factor for which the absolute quantization value does not exceed a prescribed maximum value (8191 in AAC) is referred to as a west scale factor (west SF). In FIG. 3, point W represents such a scale factor. In this case, the NMR assumes a minimum value. For each band, before executing the inner loop, the east and west scale factors and maximum and minimum NMRs can be determined in advance.

Figure 4:
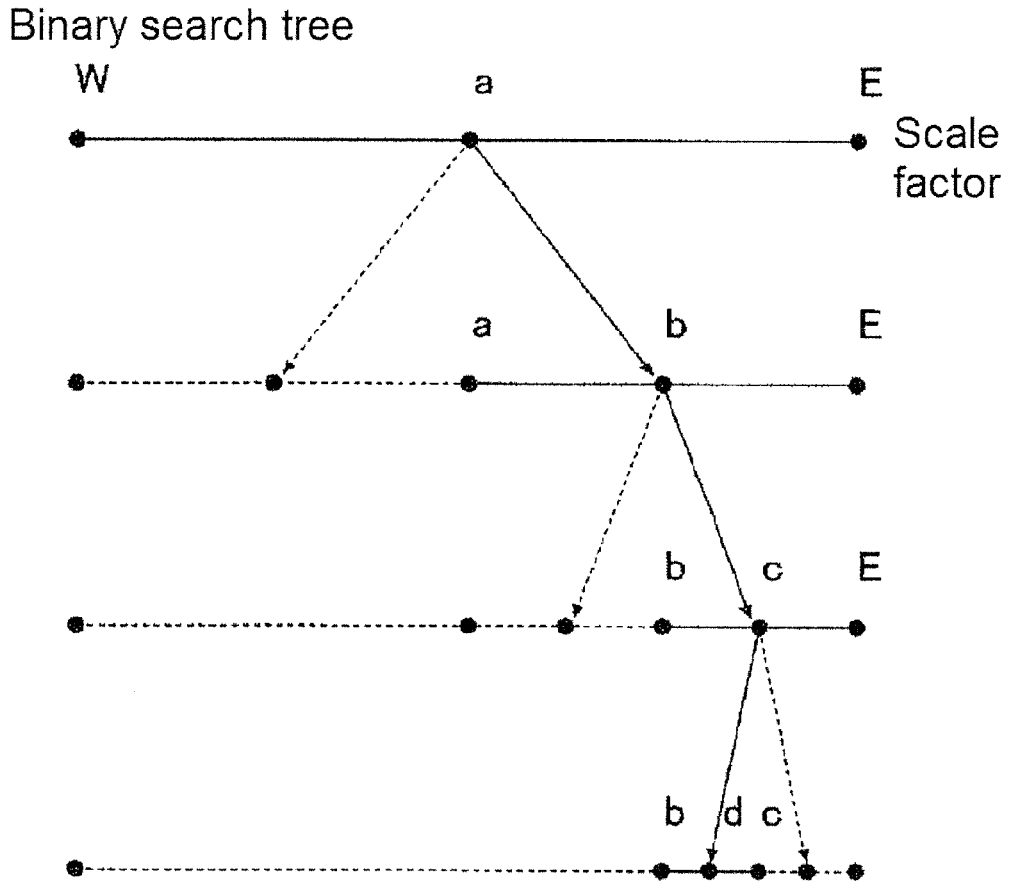
FIG. 4 Shows an example of a binary search tree that determines a scale factor corresponding to a target NMR.

In this mode of embodiment, for each band a scale factor corresponding to a target NMR is determined by performing a binary search. In concrete terms, if the target NMR is between the maximum NMR and the minimum NMR in that band, a binary search is executed starting from the interval (W, E), and a maximum scale factor that does not exceed the given target NMR is searched for. If the target NMR is greater than the maximum NMR for that band, the east scale factor is employed. Conversely, if the target NMR is less than the minimum NMR, the west scale factor is used. FIG. 4 shows an example of a binary search tree for finding a scale factor corresponding to the target NMR.

In the example of FIG. 3, the interval is made narrower in the sequence (W, E)→(a, E)→(b, E)→(b, c). The process of the binary search is saved as the type of binary search tree shown in FIG. 4, for example. When the inner loop is re-executed, the recalculation of NMR by AbS can be omitted by tracing the saved binary search tree. In the outer loop, for a binary search, the inner loop is executed repeatedly using similar target NMRs. For this reason, in the repetition of a binary search using the inner loop, it can be expected that the saved binary search tree can be traced at a high probability, and the benefit of omitting recalculations can be magnified.

Figure 5:
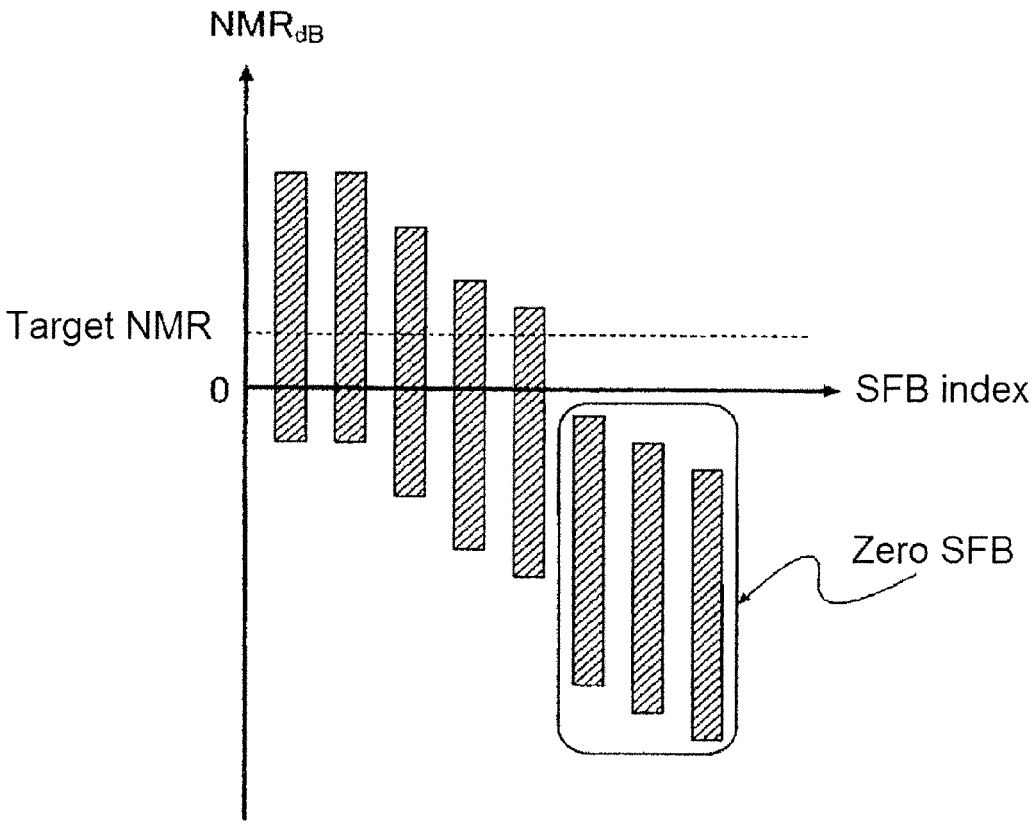
FIG. 5 Shows a range of NMR by scale factor band.

FIG. 5 shows ranges of NMR for each scale factor band. In FIG. 5, the vertical axis represents the NMR, and the horizontal axis the SFB (Scale Factor Band) index. The greater the index, the higher the frequency. As shown in FIG. 5, generally the range of an NMR differs from one band to another. In particular, in the high frequency region, due to large mask energy the maximum value of NMR is frequently below 0. In the bands in which the target NMR is greater than the maximum NMR or smaller than the minimum NMR, no binary search is required. If the target NMR is greater than the maximum NMR, it suffices to use the east scale factor and set the quantization value of all frequency spectra to 0; if the target NMR is less than the maximum NMR for that band, the minimum NMR, that is, the NMR for the west scale factor can be calculated for the first time; and in a band for which the target NMR is never less than the maximum NMR for that band, the calculation of the minimum NMR can be omitted. In addition, the east and west scale factors can be determined from the maximum absolute value of the frequency spectrum for that band.

Mode of an Embodiment

Figure 6:
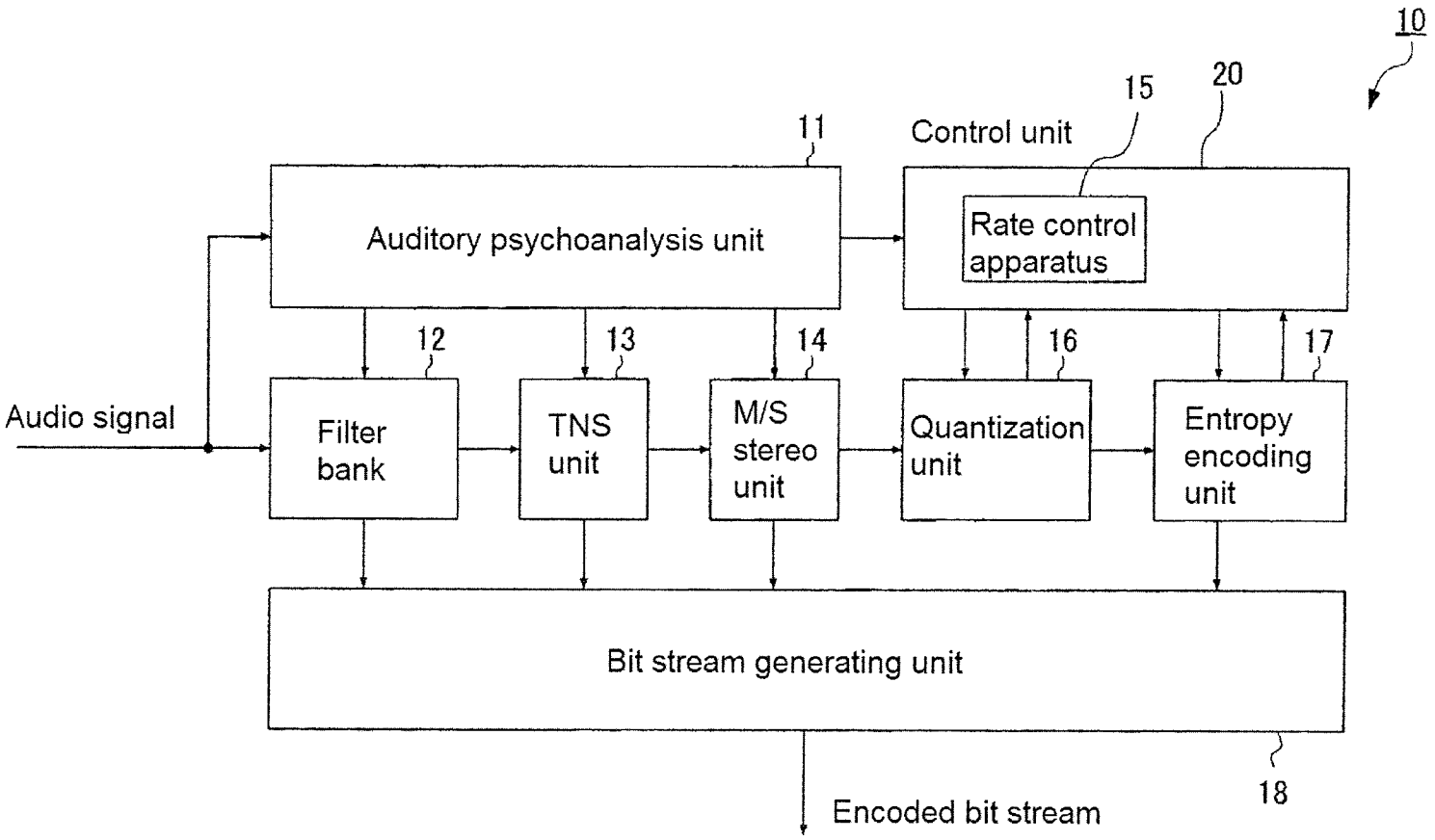
FIG. 6 A functional block diagram of the audio encoding apparatus that includes the rate control apparatus of an embodiment mode of the present invention.

FIG. 6 shows a functional block diagram of an audio encoding system containing, in its control unit, the rate control apparatus of a mode of embodiment of the present invention. As shown in FIG. 6, the audio encoding system 10 comprises an auditory psychoanalysis unit 11, a filter bank 12, a TNS (Temporal Noise Shaping) unit 12, an M/S (Middle/Side) stereo unit 14, the rate control apparatus 15 of this mode of embodiment, a quantization unit 16, an entropy encoding unit 17, and a bit stream generating unit 18. The audio encoding system 10 divides the frames generated from input signals into multiple scale factor bands, encodes the multiple scale factor bands by using a scale factor, and outputs an encoded bit stream from the bit stream generating unit 18.

The audio signal is input into the auditory psychoanalysis unit 11 and the filter bank 12. The auditory psychoanalysis unit 11 performs auditory psychoanalyses according to an auditory psychology model. Based upon the results of the analyses, the encoding-related units including the filter bank, the TNS unit 13, the M/S stereo unit 14, and so forth, as well as the control unit 20, operate.

The filter bank 12 performs temporal frequency transform into temporal signals composed of audio samples, and transforms the results into frequency spectra. The frequency spectra are further input into several encoding-related units (not shown). These encoding-related units output the auxiliary information necessary for decoding to the bit stream generating unit 18. For ease of explanation, in FIG. 6 encoding-related units other than the TNS unit 13 and the M/S stereo unit 14 available in the AAC are omitted.

The frequency spectra thus processed in the encoding-related units are then input into the quantization unit 16. The quantization unit 16, quantizing the frequency spectra, generates quantized spectra, and outputs the results to the entropy encoding unit 17. The entropy encoding unit 17 performs the entropy encoding of the quantized spectra. The control unit 20 controls the quantization unit 16 and the entropy encoding unit 17, and performs rate controls. Specifically, information on the mask energy of the scale factor bands is provided by the auditory psychoanalysis unit 11, to the rate control apparatus 15 in particular. Further, information on noise energy is provided by the quantization unit 16, to be described later. The scale factor determination unit 2 of the rate control apparatus 15 calculates an NMR (Noise-to-Mask Ratio) as a ratio of the noise energy determined by AbS on the respective scale factor bands to given mask energy. It determines an optimal scale factor by comparing the calculated NMR with a target NMR. The control unit 20 controls the quantization unit 16 and the entropy encoding unit 17 by using the scale factors and rates based on the optimal NMR obtained from the rate control apparatus 15.

Upon completion of the rate control process, the entropy encoding unit 17 outputs auxiliary information and encoded data to the bit stream generating unit 18. By combining all auxiliary information and encoded data, the bit stream generating unit outputs a coded audio bit stream.

Figure 7:
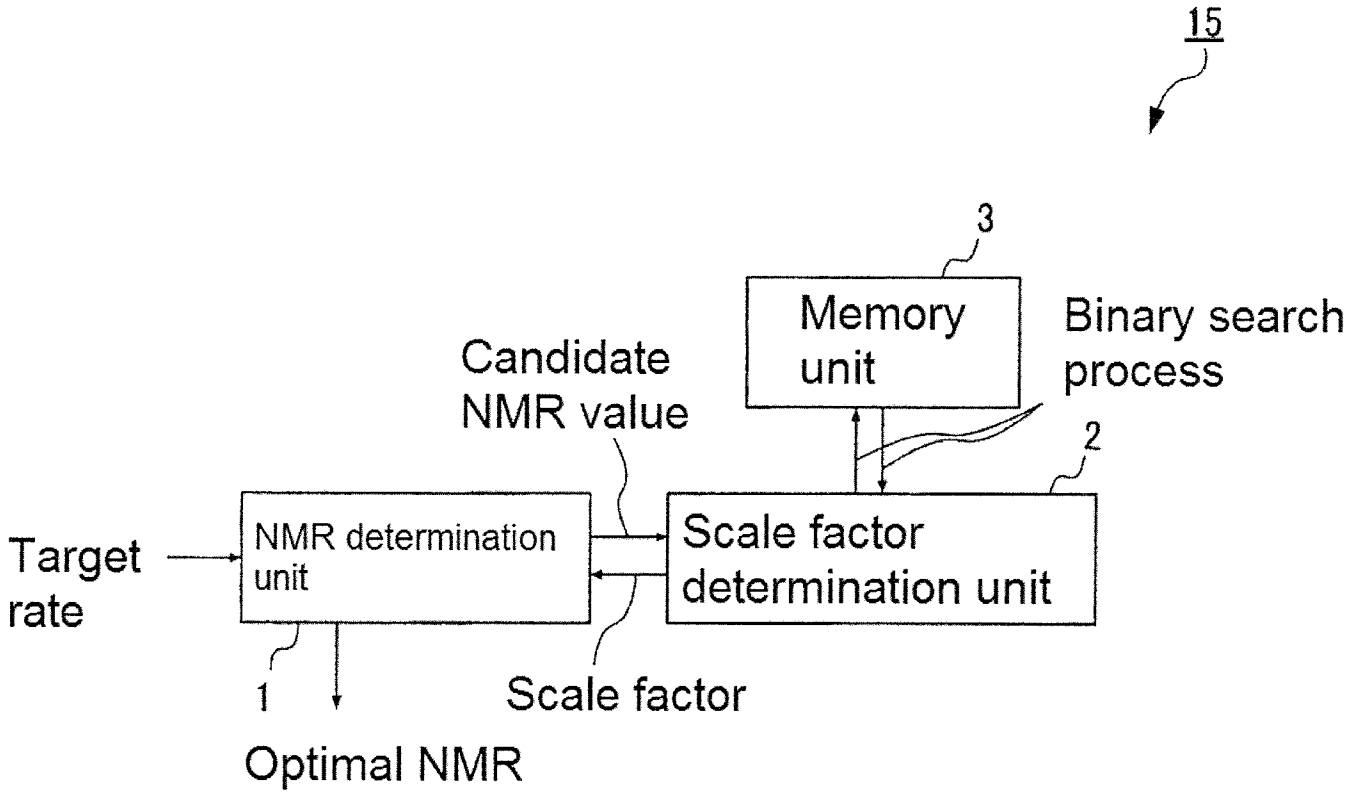
FIG. 7 A schematic functional block diagram of the rate control apparatus of FIG. 6.

FIG. 7 shows a schematic functional block diagram of the rate control apparatus 15 of the present mode of embodiment. The rate control apparatus 15 being a rate control apparatus that performs rate control based upon an NMR which is a ratio of noise energy and mask energy based on a predetermined auditory psychology model, it comprises an NMR determination unit 1 that determines an NMR not exceeding a target rate by a binary search, and a scale factor determination unit 2 that determines by a binary search for each scale factor band, a maximum scale factor corresponding to the NMR that was determined by the NMR determination unit 1. Each time the NMR determination unit 1 selects an NMR candidate that acts as a candidate during a binary search for an NMR, the scale factor determination unit 2 determines a scale factor with respect to the NMR candidate, and the NMR determination unit 1 is designed to determine, as the optimal NMR, the smallest NMR based upon the difference between the rate on the NMR candidate calculated based upon the scale factor determined by the scale factor determination unit and the target rate.

Figure 8:
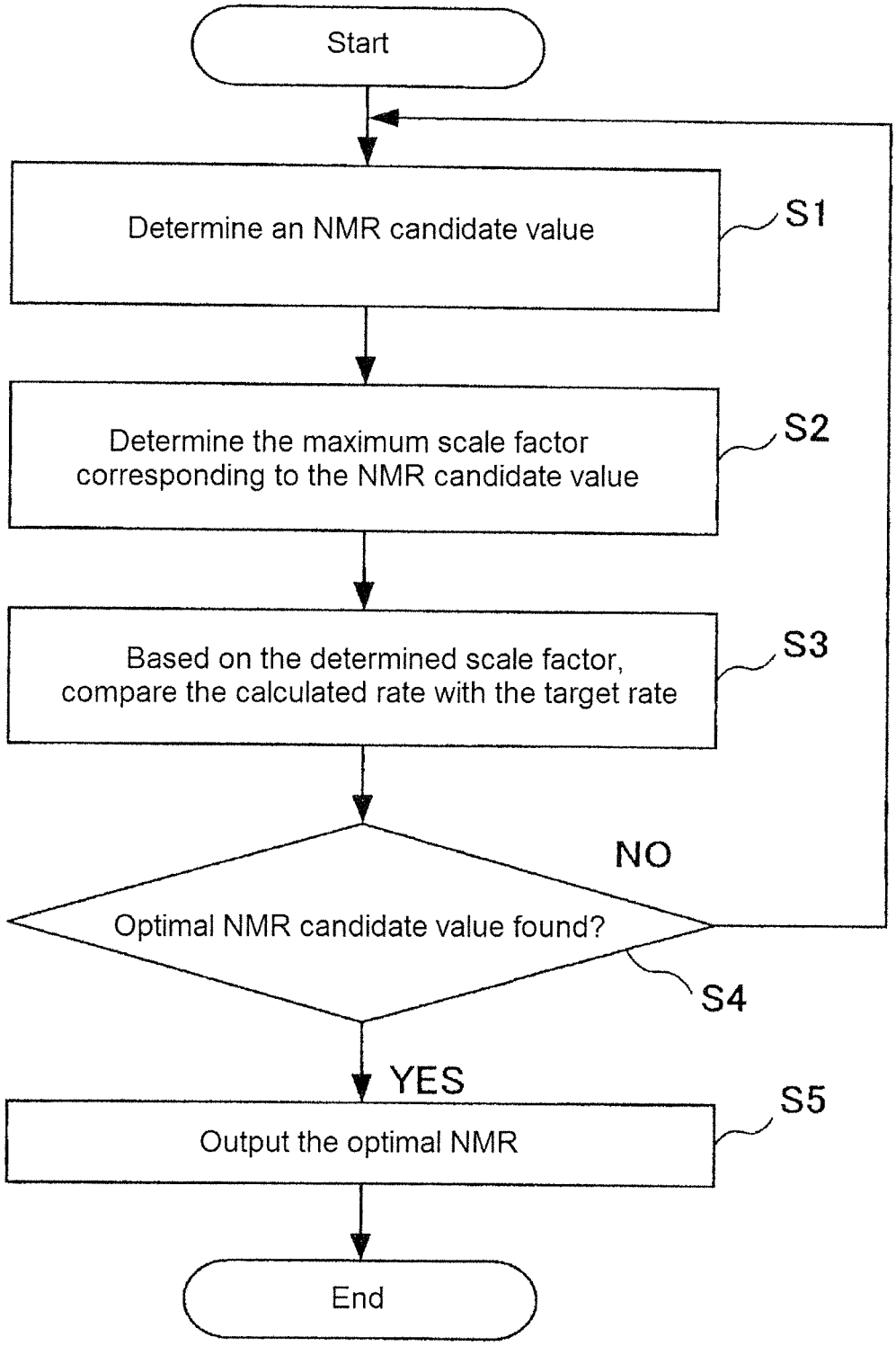
FIG. 8 A flowchart depicting the processing executed by the rate control apparatus of FIG. 6.

FIG. 8 is a flowchart depicting the rate control processing that the rate control apparatus 15 of the present mode of embodiment executes. The processing tasks described below are executed by the CPU and under the control of CPU-related programs, not shown, contained in the rate control apparatus 15.

First, in Step S1 the NMR determination unit 1 determines an NMR candidate value by a binary search. Further, in the case of stage 1 of the binary search, as an initial NMR candidate value the NMR used during the encoding of the previous frame, for example, may be employed.

In Step S2, the scale factor determination unit 2, for each scale factor band, determines, by a binary search, the largest scale factor corresponding to the NMR candidate value that was determined by the NMR determination unit 1. In the present mode of embodiment, the scale factor determination unit 2 further calculates a rate corresponding to the determined scale factor also. The present invention, however, is not limited to this; it must be obvious to persons skilled in the art that the rates corresponding to the scale factor determined by the scale factor determination unit 2 can be calculated by any other components.

In Step S3, the NMR determination unit 1 calculates and compares the difference between the rate with respect to the NMR candidate value calculated based upon the scale factor determined by the scale factor determination unit 2 and a target rate.

In Step S4, the NMR determination unit 1 tests whether an optimal NMR candidate value based on the difference between the target rate and the calculated rate determined in Step S3 was found. Specifically, the NMR determination unit 1 judges that an optimal NMR candidate value was found when the interval of the binary search for an NMR is sufficiently made narrow.

If it is judged in Step S4 that an optimal NMR candidate value was found, control moves to Step S5, and outputs the east NMR candidate value for the NMR binary search interval that was sufficiently narrowed, that is, the smallest NMR candidate value that does not exceed the target rate, as the optimal NMR. On the other hand, if it is judged in Step S4 that an optimal NMR was not found, the processing returns to Step S1.

Thus, the rate control apparatus 15 of the present mode of embodiment comprises an NMR determination unit 1 that determines an NMR not exceeding a target rate by a binary search, and a scale factor determination unit 2 that determines by a binary search for each scale factor band, a maximum scale factor corresponding to the NMR that was determined by the NMR determination unit. Each time the NMR determination unit 1 selects an NMR candidate that acts as a candidate during a binary search for an NMR, the scale factor determination unit 2 determines a scale factor and a rate with respect to the NMR candidate, and the NMR determination unit 1 determines, as the optimal NMR, the smallest NMR based upon the difference between the rate with respect to the NMR candidate value calculated based upon the scale factor determined by the scale factor determination unit and the target rate. By such a constitution, the rate control apparatus of the present mode of embodiment can satisfy a target rate and simultaneously maintain a fixed NMR, that is, maintain a fixed level of quality, to the maximum possible extent.

Here, the NMR determination unit 1 starts a binary search from the interval defined by a predicted NMR value and an NMR candidate value that is selected so that the rates corresponding to said predicted NMR value include the target rate between them. Further, the scale factor determination unit 2, for each scale factor band, sets as a west scale factor the smallest scale factor among the scale factors for which the absolute quantized value of the frequency spectra does not exceed a previously established maximum value, with respect to the NMR candidate value selected by the NMR range determination unit; and calculates the smallest scale factor for the scale factors for which the quantized values of frequency spectra are all zero as an east scale factor; and begins a binary search for a maximum scale factor corresponding to the NMR, beginning with the interval defined by the west and east scale factors. For this reason, the rate control apparatus 15 of the present mode of embodiment can effectively reduce the interval in which binary searches are performed.

Further, the scale factor determination unit 2 calculates the minimum and the maximum of NMRs based upon the west and east scale factors. The scale factor determination unit 2 determines the west scale factor as a scale factor with respect to the NMR candidate value if the scale factor calculated with respect to the NMR candidate value is smaller than the west scale factor; and determines the west scale factor as a scale factor with respect to the NMR candidate value if the scale factor calculated with respect to the NMR candidate value is smaller than the east scale factor.

Further, the rate control apparatus 15 comprising a memory unit 3 that stores the process of binary search executed by the scale factor determination unit 2, the scale factor determination unit 2 performs a binary search based upon the process of binary search stored in the memory unit 3. In addition, target rates can be made variable within a prescribed range. If a target rate is provided with some latitude, the NMR determination unit 2 first uses a predicted NMR value to calculate the amount of encoding, and if the amount of encoding is within the target rate, it can set the predicted NMR value as the optimal NMR, and terminate the rate control process without executing a binary search. For example, it is possible to feedback-control the NMR determination unit so that the encoding amount of the next frame, that is, the target rate, is increased or decreased according to the extent of deviation from the target value for the bit reserver, or 80%, for example, of the maximum value of the bit reserver. By allowing the rate to fluctuate in the short term, or by maintaining the signal quality at a fixed level to the maximum possible extent, it is possible to perform encoding at a fixed rate over the long term.

Further, the NMR determination unit 1 can be constructed such that it updates the predicted NMR value each time a frame is encoded. The predicted NMR value may be revised, for example, according to its fluctuations from a bit reserver target value each time that a frame is encoded. Since the scale factor is determined based upon a more or less fixed predicted NMR value, while keeping quality at a fixed level to the maximum possible extent, it is possible to perform controls so that the rate is fixed over the long term while absorbing short-term rate fluctuations by means of a bit reserver. In this manner, it is possible to effectively use bit reservers so that more adaptive rate controls can be provided.

It should be noted that the rate control apparatus 15 of the present invention can be implemented by means of a rate control program that causes a general-purpose computer to function as the above-described means, the computer including a CPU and a memory unit. Such a rate control program can be distributed via communication circuits or by writing it into a recording medium such as a CD-ROM.

We now continue with the description by assuming that the functions of the scale factor determination unit 2 of the rate control apparatus 15 are implemented as an inner loop in a computer including a CPU and a memory unit, wherein the functions of the NMR determination unit 1 in the rate control apparatus 15 in the present mode of embodiment constitute an outer loop.

Figure 9:
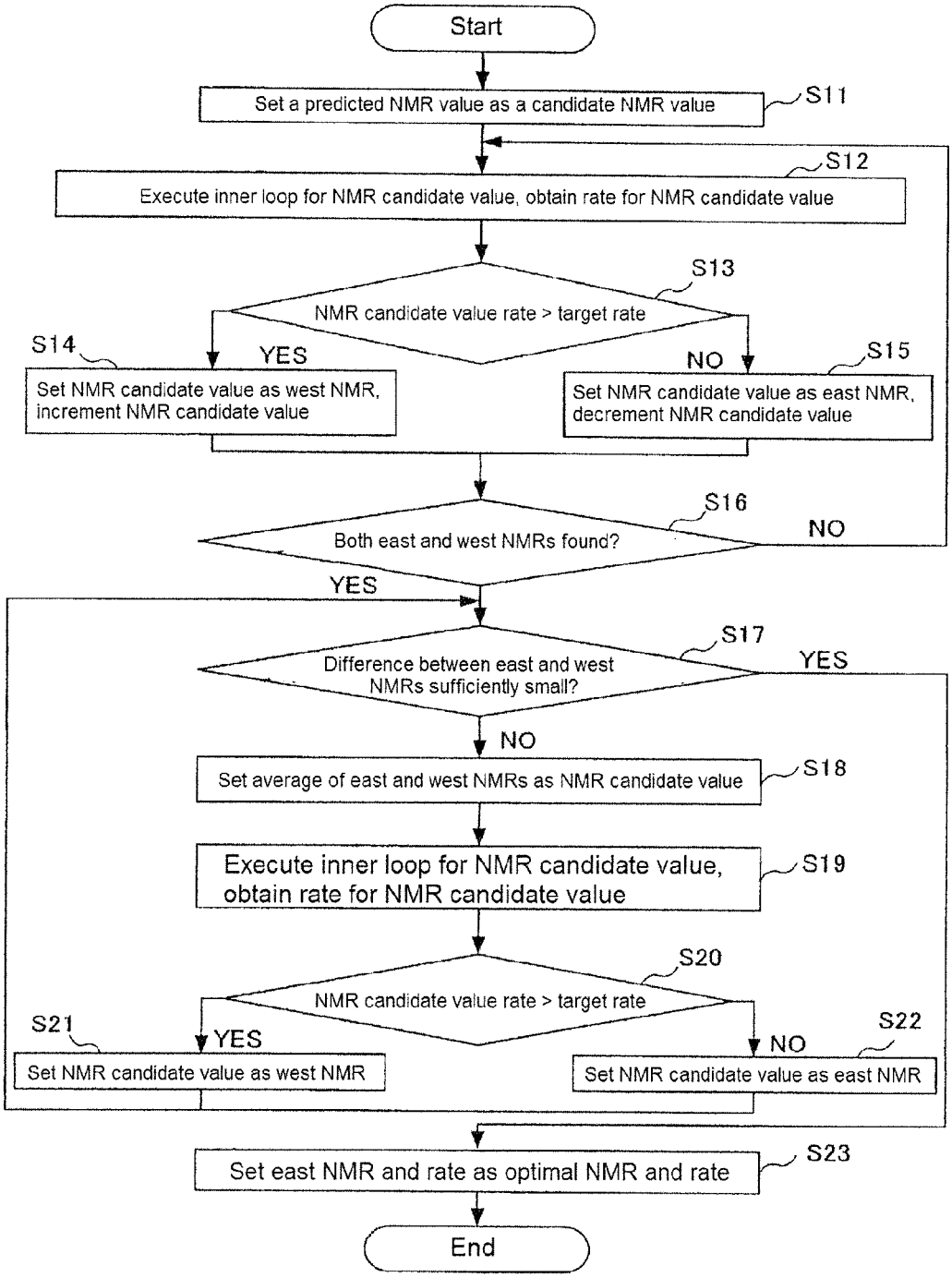
FIG. 9 A flowchart depicting the flow of the outer loop that executes the function of the NMR determination unit 1 in the rate control apparatus 15.

FIG. 9 is a flowchart depicting the flow of the outer loop that causes the computer including a CPU and a memory unit to execute the functions of the NMR determination unit 1 of the rate control apparatus 15. The following processing is executed under the control of the CPU according to the program stored in the memory.

First, an predicted NMR value is set as an NMR candidate value (S11); for the NMR candidate value the inner loop is executed, and a rate for the NMR candidate value is obtained (S12). A test is made to determine whether the rate of the NMR candidate value is greater than the target rate (S13). If it is determined that the rate of the NMR candidate value is greater than the target rate, the NMR candidate value is set as a west NMR, and the NMR candidate value is incremented by a prescribed value (S14). If it is determined that the rate of the NMR candidate value is not greater than the target rate, the NMR candidate value is set as an east NMR, and the NMR candidate value is decremented by a prescribed value (S15).

In succession, a test is made as to whether both east and west NMRs were found (S16). If it is determined that such NMRs were not found, control returns to Step S12. If it is determined that such NMRs were found, a test is made as to whether the difference between the east and west NMRs is sufficiently small (S17). To determine whether the difference between the east and west NMRs is sufficiently small, the difference between the east and west NMRs is compared with a prescribed value, for example; if it is greater than the prescribed value, it is determined that the difference between the east and west NMRs is not sufficiently small. If it is determined that the difference between the east and west NMRs is sufficiently small, the east NMRs are set as the optimal NMR rates, respectively (S23), and the processing is terminated. If it is determined that the difference between the east and west NMRs is not sufficiently small, the average of the east and west NMRs is set as an NMR candidate value (S18). The inner loop is executed on the NMR candidate value, and an NMR candidate value rate is obtained (S19). A test is made as to whether the NMR candidate value rate is greater than a target rate (S20). If it is determined that the NMR candidate value rate is greater than the target rate, the NMR candidate value is set as a west NMR (S21); if it is determined that the NMR candidate value rate is not greater than the target rate, the NMR candidate value is set as an east NMR (S22). Next, control returns to Step S17.

Figure 10A:
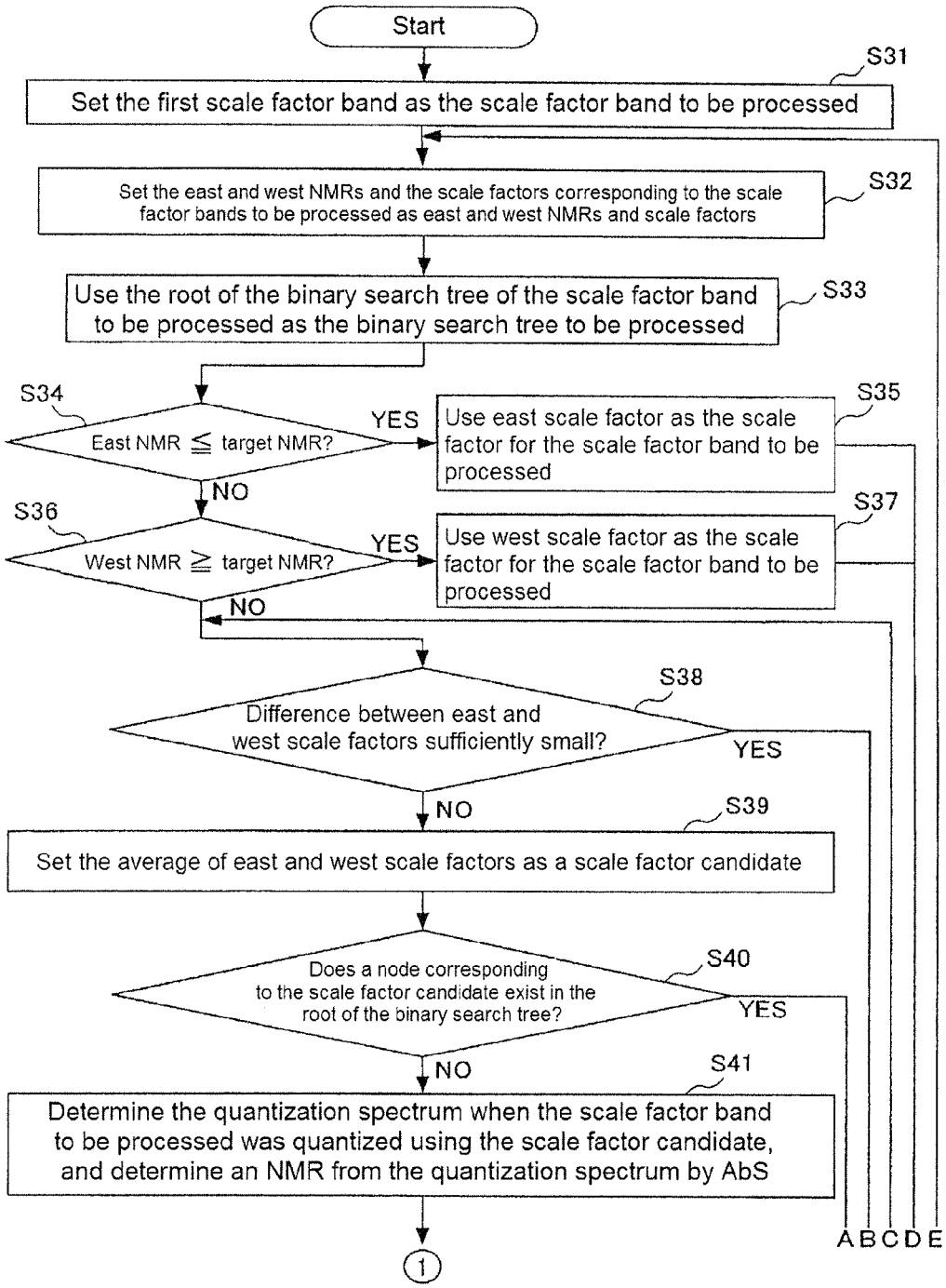
FIG. 10 A flowchart depicting the flow of the outer loop that executes the function of the NMR determination unit 2 in the rate control apparatus 15.
Figure 10B:
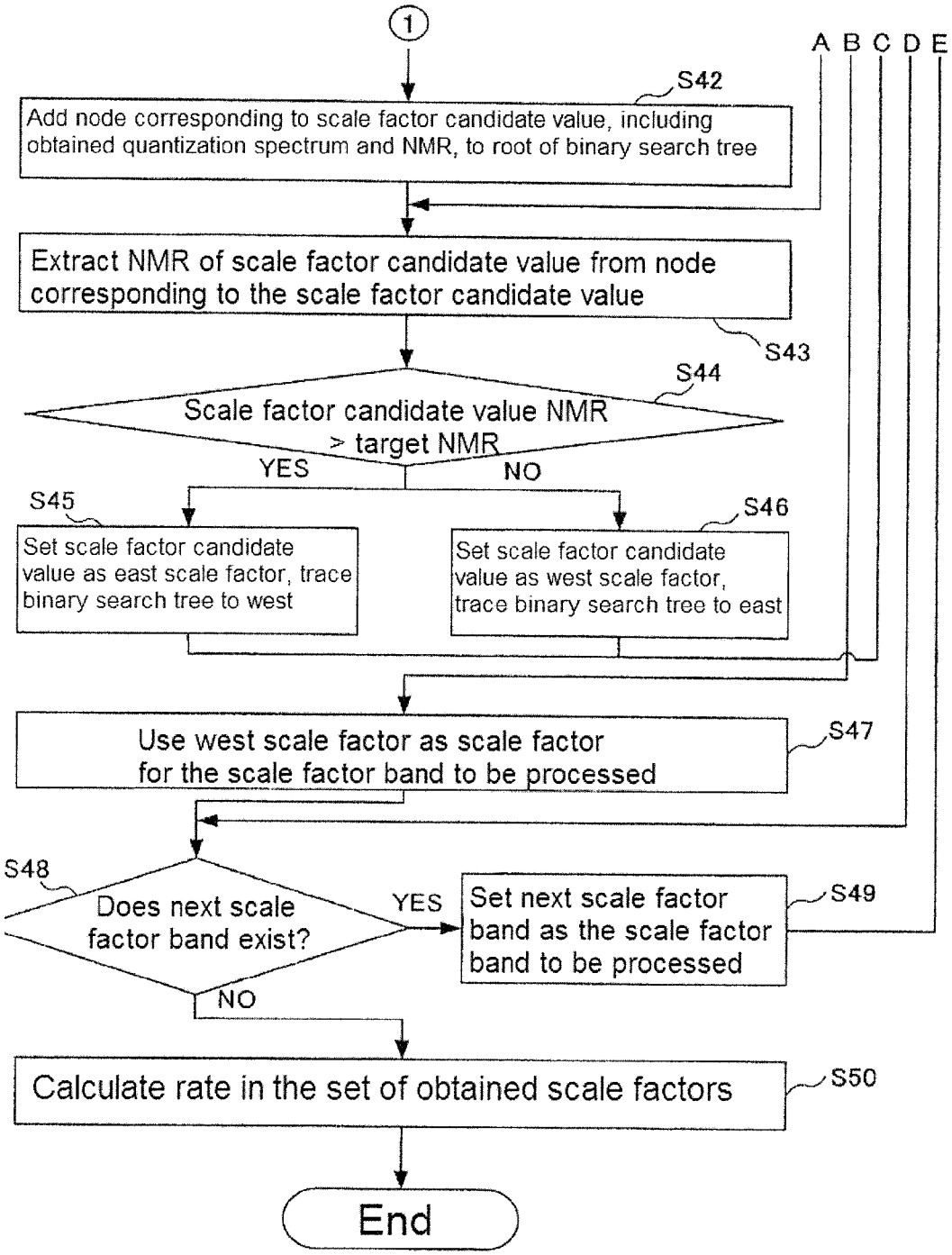
Figure 16:
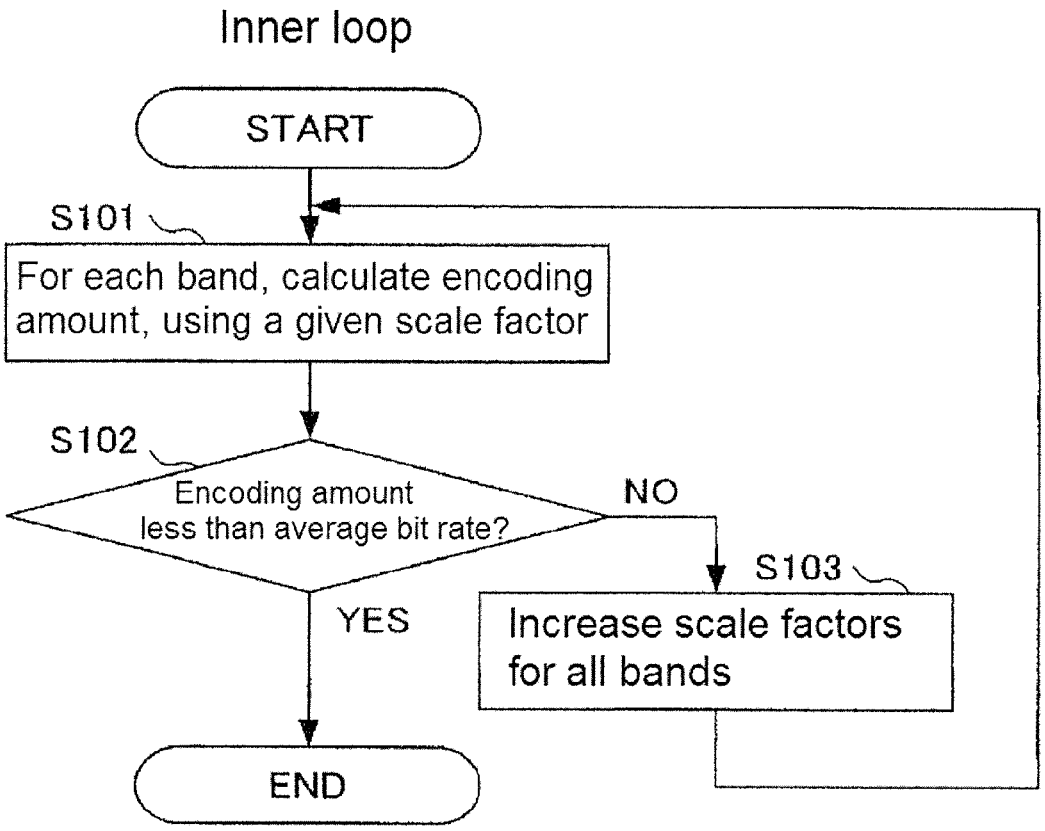
FIG. 16 A flowchart depicting the processing of the outer loop that the conventional rate control apparatus executes.
Figure 17:
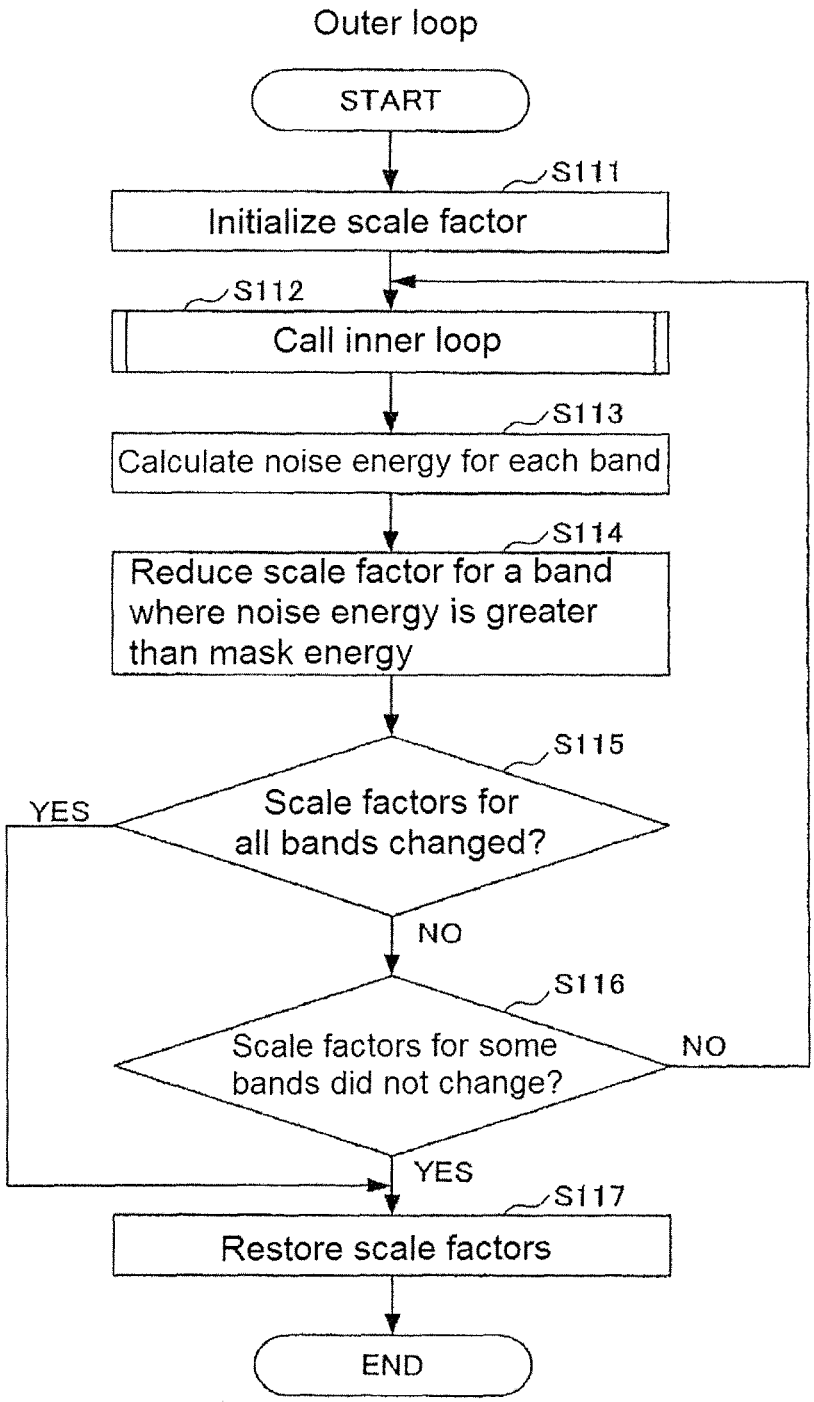
FIG. 17 A flowchart depicting the processing of the inner loop that the conventional rate control apparatus executes.

FIGS. 10A and 10B are flowcharts depicting the flow of the outer loop that causes the computer including a CPU and a memory unit to execute the functions of the NMR determination unit 1 of the rate control apparatus 15.

First, the first scale factor band is set as the scale factor band to be processed (S31). Next, the east and west NMRs and scale factors corresponding to the scale factor band to be processed are set as east and west NMRs and scale factors to be processed, respectively (S32). The root of the binary search tree for the scale factor band to be processed is used as the binary search tree to be processed (S33).

Next, a test is made as to whether the east NMR is less than a target NMR (S34). If it is determined that the east NMR is less than the target NMR, the east scale factor is used as the scale factor for the scale factor band to be processed (S35), and the processing moves to Step S48. If it is determined that the east NMR is greater than the target NMR, a test is made as to whether the west NMR is greater than the target NMR (S36). If it is determined that the west NMR is greater than the target NMR, the west scale factor is used as the scale factor for the scale factor band to be processed (S37), and the processing moves to Step S48.

Next, a determination is made as to whether the difference between the east and west scale factors is sufficiently small (S38). If it is determined that the difference between the east and west scale factors is sufficiently small, the processing moves to Step S47. If it is determined that the difference between the east and west scale factors is not sufficiently small, the average of the east and west scale factors is set as a scale factor candidate value (S39). To determine whether the difference between the east and west scale factors is sufficiently small, the difference between the east and west scale factors is compared with a prescribed value; if it is less than the prescribed value, it is determined that the difference between the east and west scale factors is sufficiently small; if it is greater than the prescribed value, it is determined that the difference between the east and west scale factors is not sufficiently small.

Next, a test is made as to whether a node corresponding to the scale factor candidate value exists in the root of the binary search tree (S40). If it is determined that a node corresponding to the scale factor candidate value exists in the root of the binary search tree, the processing moves to Step S43. If it is determined that a node corresponding to the scale factor candidate value does not exist in the root of the binary search tree, the quantization spectra produced by the quantization of the scale factor band to be processed with a scale factor candidate value are obtained, and further, an NMR is obtained from the quantization spectra by AbS (S41). Further, the node corresponding to the scale factor candidate value, including the obtained quantization spectrum and NMR, is added to the root of the binary search tree (S42). From the node corresponding to the scale factor candidate value, the NMR of the scale factor candidate value is extracted (S43).

In succession, a test is performed to determine whether the NMR of the scale factor candidate value is greater than the target NMR (S44). If it is determined that the NMR of the scale factor candidate value is greater than the target NMR, the scale factor candidate value is set as an east scale factor, the binary search tree is traced to the west (S45), and the processing moves to Step S38. If it is determined that the NMR of the scale factor candidate value is not greater than the target NMR, the scale factor candidate value is set as a west scale factor, the binary search tree is traced to the east (S46), and the processing moves to Step S38.

If it is determined in Step S38 that the difference between the east and west scale factors is sufficiently small, the west scale factor is used as the scale factor for the scale factor band to be processed (S47). A test is then made as to whether the next scale factor band exists (S48). If it is determined that that the next scale factor band exists, the next scale factor band is set as the scale factor band to be processed (S49), and the processing returns to Step S32. On the other hand, if it is determined that another scale factor band does not exist, the rate in the set of obtained scale factors is calculated (S50).

FIG. 11 shows pseudo-code that explains the flow of the outer loop that causes the computer including a CPU and a memory unit to execute the functions of the NMR determination unit 1.

In the outer loop, the NMR is allowed to vary, the rate control is performed so that the rate of the frame to be processed is less than the target rate. In what follows, unless otherwise noted, a decibel value is used as an NMR, and the smallest unit by which the NMR is varied is denoted as ΔNMR (for example, ΔNMR=0.3 dB). If i denotes a quantized NMR, the value of the corresponding NMR can be determined by the inverse-quantized iΔNMR .

The function outer_loop( ) accepts the set of the initial value of the quantized NMR (target value) and the target rate into its argument. First, the interval at which outer_loop_first( ) performs a binary search, that is, east and west quantized NMRs and their corresponding rates, are determined. $NMR^{max}$ and $NMR^{min}$ denote the maximum and minimum NMRs that the frames to be processed can take, respectively, and $$[NMR^{max}/\Delta NMR] \text{ and} \quad \text{[Eq. 2]}$$

$$[NMR^{min}/\Delta NMR] \quad \text{[Eq. 3]}$$

represent the maximum and minimum quantized NMRs that the frame can take, respectively.

Here, $\lfloor x \rfloor$ denotes a floor function (i.e., the largest integer not greater than x); $\lceil x \rceil$ denotes a ceiling function (i.e., the smallest integer not less than x). [Eq. 4]

When the interval for a binary search is determined, outer_loop_second( ) performs the binary search, and returns a set of optimal quantized NMRs and the resulting rates. If the target rate is not within the range of rates that the frame can take, an interval for binary search cannot be determined. If the maximum rate is less than the target rate, that is, if a west point cannot be determined, the east point yielding a maximum rate is returned as an optimal value. If the minimum rate is greater than the target rate, that is, if an east point cannot be determined, the set of special quantized NMR, $I^{\infty}$ indicating that all spectra and other auxiliary information are omitted and the resulting encoding amount are returned.

If the quantized NMR is greater than $I^{\infty}$, the rate is less than a fixed value (referred to as the lower limit on the rate), irrespective of the content of the frame; therefore, successful rate control can be ensured by insisting that the target rate is always greater than the lower limit (by controlling the rate to less than the target rate).

FIG. 12 shows pseudo-code explaining the flow of Stage 1 of the outer loop. The function outer_loop_first( ) takes as arguments the initial value of the quantized NMR, a target rate, the maximum value of the quantized NMR, and the minimum value of the quantized NMR, in the indicated order. Starting with the initial value, outer_loop_first( ) gradually lets the quantized NMR vary, and searches for an interval that includes the target rate between its end points. When finished with the search, the loop returns the west and east quantized NMRs and rates. The function inner_loop_first( ) calculates a rate for a given quantized NMR. The amount of change k of the quantized NMR is initialized to a value which is determined by the deviation of the actual rate from the target rate, and it increases at a fixed ratio (1.5-fold, for example). The constant DBR represents the amount of change in NMR per bit of rate, or an approximate value of the amount of change in NMR. For example, if it is assumed that a 6 dB improvement in NMR can be obtained by increasing the amount of encoding per sample by 1 bit, it follows that for a frame containing data with 1024 sample, DBR=6/1024.

FIG. 13 shows pseudo-code explaining the flow of Stage 2 of the outer loop. The function outer_loop_second( ) takes as arguments the interval of binary search (west and east quantized NMRs and rates) and a target rate. The loop, by a binary search, finds by a binary search the smallest quantized NMR (referred to as an optimized quantized NMR) that does not exceed the target rate, and returns a set of optimized quantized NMRs and resulting rates. Specifically, when the range of binary search for NMRs is made sufficiently small, that is, when the difference between the east and west quantized NMRs becomes 1, the loop returns a set of west quantized NMRs and west rates.

FIG. 14 shows pseudo-code explaining the flow an inner loop that causes a computer including a CPU and a memory unit to execute the function of the of scale factor determination unit 2. The function inner_loop( ) takes a (target) quantized NMR as an argument. If the quantized NMR is greater than $I^{\infty}$, the loop returns the rate calculated by the function simulate_zero ( ). The function simulate_zero ( ) calculates the rate with all spectra and miscellaneous auxiliary information omitted. If the quantized NMR is less than $I^{\infty}$, the function determines a rate as follows: First, for each scale factor band, the largest scale factor that does not exceed a given NMR is searched for by means of the function allocate_noise ( ). Next, with respect to the set of scale factors found by allocate_noise ( ), the rate is calculated by the function simulate ( ). $ROOT_j$ represents the root node of the binary search tree in the j-th band, and $\&ROOT_j$ denotes a pointer to that node. $SF_j^{west}$ and $SF_j^{east}$ and $NMR_j^{east}$ represent, respectively, the west and east scale factors for the j-th band. Pseudo-code for the functions simulate_zero ( ) and simulate ( ) is omitted. In the case of a band for which the target NMR is not less than it maximum NMR of the band, it is not necessary to calculate a minimum NMR.

FIG. 15 shows pseudo-code explaining the flow that determines a scale factor by means of a binary search. The function allocate_noise ( ) takes as respective arguments a pointer to the root node of the binary search tree, data on a scale factor band, a west scale factor, an east scale factor, a west NMR, an east NMR, and a target NMR. Because the pointer to the root node is passed to the argument tt, any change made to *tt is reflected in the source of the call.

The function allocate_noise ( ) returns either the east or west scale factor, whichever is closer to the target NMR, if the target NMR does not exist between the east and west NMRs. If the target NMR is between east and west, the function finds the scale factor by a binary search. Initially, no memory is allocated to the nodes of the binary search tree containing the root node. In the process of search, memory is allocated when a new node is traced. If $t=\phi$ is true, no memory is allocated. When $t\neq\phi$, the node t can at a minimum access NMR t:nmr, west child node $t:node^{west}$ and east child node $t:node^{east}$.

The function new_node ( ) returns a node that has an NMR when the scale factor band sfb is quantized with the scale factor sf ($\phi$ is assigned to either child node). In AAC, the quantization step corresponding to the scale factor sf is expressed as $q=2^{sf/4}$, meaning that quantization can be controlled at approximately 1.5 dB. Calculations can be omitted by further including the quantized spectra in the node so that quantization is not repeated during the code generation after rate control. Pseudo-code for the function new_node ( ) is omitted.

As described above, the rate control apparatus of the present mode of embodiment comprises an NMR determination unit that determines, by a binary search, the smallest NMR that does not exceed a target rate; and a scale factor determination unit that determines, by a binary search, the largest scale factor corresponding to the NMR determined by the NMR determination unit; wherein the scale factor determination unit determines a scale factor with respect to an NMR candidate value each time that the NMR determination unit selects an NMR candidate value that acts as a candidate when a binary search is made for an NMR; and wherein the NMR determination unit determines the smallest NMR based upon the difference between the rate on the NMR candidate value calculated based upon the scale factor determined by the scale factor determination unit and the target rate. Consequently, the rate control apparatus of the present mode of embodiment can satisfy the target rate and simultaneously NMR requirements, that is, quality requirements. Since an NMR less than the target rate is determined by a binary search and a scale factor is determined based upon the NMR thus found, rate fluctuations with some width can be accommodated, and in this manner the bit reserver can be employed effectively.

Whereas various modes of embodiment of the present invention were described above in detail with references to drawings, specific constitutions are not limited to these modes of embodiment. Various modifications and improvements within a scope that can implement the objective of the present invention are included in the scope of the present invention. For example, whereas the above mode of embodiment described an audio encoding apparatus that performs encoding according to AAC, the present invention is not limited to AAC-based encoding methods; it can be applied to rate control base on noise energy and mask energy.

What is claimed is:

1. In an audio encoding system that divides frames generated from input signals into multiple scale factor bands and that encodes each of said multiple scale factor bands by using a scale factor, a rate control apparatus that performs rate controls based upon an NMR which is the ratio of noise energy to mask energy based on a predetermined auditory psychological model, wherein said rate control apparatus comprises:

an NMR determination unit that determines, by a binary search, an NMR that does not exceed a target rate;

and a scale factor determination unit that determines, for each scale factor band and by a binary search, the maximum scale factor that corresponds to the NMR that was determined by said NMR determination unit;

wherein each time said NMR determination unit selects an NMR candidate value that acts as a candidate when the NMR is searched for by a binary search, said scale factor determination unit determines a scale factor and a rate with respect to said NMR candidate value;

and wherein said NMR determination unit determines as the optimal NMR the smallest NMR that does not exceed a target rate, based upon the difference between the rate with respect to said NMR candidate value that was calculated based on the scale factor determined by said scale factor determination unit and said target rate.

2. The rate control apparatus of claim 1, wherein said NMR determination unit starts a binary search from an interval that is defined by a predicted NMR value and an NMR candidate value that is selected such that rates corresponding to the rates with respect to said predicted NMR value include said target rate between them.

3. The rate control apparatus of claim 1, wherein said scale factor determination unit sets, for each scale factor band, the smallest scale factor among the scale factors whose absolute quantization value of frequency spectra does not exceed a previously established maximum value as a west scale factor; and calculates, as an east scale factor, the smallest scale factor for which the quantization values of frequency spectra are all zero; and wherein a binary search is started for the maximum scale factor corresponding to the NMR candidate value that was selected by said NMR determination unit, from an interval that is demarked by said west scale factor and said east scale factor.

4. The rate control apparatus of claim 3, wherein said scale factor determination unit calculates the maximum and minimum NMRs based upon the west scale factor and the east scale factor that were calculated by said scale factor determination unit;

wherein and said scale factor determination unit determines said west scale factor as a scale factor with respect to said NMR candidate value if said NMR candidate value is less than the minimum NMR;

and wherein the scale factor determination unit determines said east scale factor as a scale factor with respect to said NMR candidate value if said NMR candidate value is greater than the maximum NMR.

5. The rate control apparatus of claim 1, wherein the rate control apparatus further comprises a memory unit that stores the process of binary search executed by said scale factor determination unit; and wherein said scale factor determination unit executes a binary search based upon the process of binary search stored in said memory unit.

6. The rate control apparatus of claim 1, wherein said target rate can be variable within a prescribed range.

7. The rate control apparatus of claim 6, wherein said NMR determination unit determines said NMR as the optimal NMR if the rate calculated based on a predicted NMR value is within said prescribed range.

8. The rate control apparatus of claim 1, wherein said NMR determination unit updates the predicted value of NMR each time that said frame is encoded.

9. In an audio encoding method that divides frames generated from input signals into multiple scale factor bands and that encodes each of said multiple scale factor bands by using a scale factor, a rate control method that performs rate controls based upon an NMR, which is the ratio of noise energy to mask energy based on a predetermined auditory psychological model wherein the rate control method comprises:

an NMR determination step that determines, by a binary search, an NMR that does not exceed a target rate;

a scale factor determination step that determines, for each scale factor band and by a binary search, the maximum scale factor that corresponds to the NMR that was determined in said NMR determination step;

and an evaluation step that determines whether said NMR is the smallest NMR that does not exceed the target rate by evaluating the difference between the rate on said NMR calculated based on the scale factor determined in said scale factor determination step and said target rate;

wherein each time an NMR candidate value is selected that acts as a candidate during the binary search for an NMR in said NMR determination step, a scale factor is determined on said NMR candidate value;

wherein if it is determined in said evaluation step that said NMR candidate value is the smallest NMR that does not exceed the target rate, said NMR candidate value is determined as the optimal NMR; and wherein if it is determined in said evaluation step that said NMR candidate value is not the smallest NMR that does not exceed the target rate, the steps from said NMR determination step to said evaluation step are repeated.

10. The rate control method of claim 9, wherein said NMR determination step includes starting a binary search from an interval that is defined by a predicted NMR value and an NMR candidate value that is selected such that rates corresponding to the rates with respect to said predicted NMR value include said target rate between them.

11. The rate control method of claim 9, wherein said scale factor determination step includes:

setting, for each scale factor band, the smallest scale factor among the scale factors whose absolute quantization value of frequency spectra does not exceed a previously established maximum value as a west scale factor; and calculating, as an east scale factor, the smallest scale factor for which the quantization values of frequency spectra are all zero, wherein a binary search is started for the maximum scale factor corresponding to the NMR candidate value that was selected by said NMR determination step, from an interval that is demarked by said west scale factor and said east scale factor.

12. The rate control method of claim 11, wherein said scale factor determination step includes:

calculating the maximum and minimum NMRs based upon the west scale factor and the east scale factor that were calculated by said scale factor determination step;

determining said west scale factor as a scale factor with respect to said NMR candidate value if said NMR candidate value is less than the minimum NMR; and determining said east scale factor as a scale factor with respect to said NMR candidate value if said NMR candidate value is greater than the maximum NMR.

13. The rate control method of claim 9, storing the binary search executed by said scale factor determination step in a memory unit, and wherein said scale factor determination step includes executing a binary search based upon the process of binary search stored in said memory unit.

14. The rate control method of claim 9, wherein said target rate can be variable within a prescribed range.

15. The rate control method of claim 14, wherein said NMR determination step includes determining said NMR as the optimal NMR if the rate calculated based on a predicted NMR value is within said prescribed range.

16. The rate control method of claim 9, wherein said NMR determination step includes updating the predicted value of NMR each time that said frame is encoded.

17. A non-transitory computer-readable medium storing computer executable code for rate control based on an NMR in an audio encoding that divides frames generated from input signals into multiple scale factor bands and that encodes each of said multiple scale factor bands by using a scale factor, NMR being the ratio of noise energy to mask energy based on a predetermined auditory psychological model wherein said computer executable code comprises code for:

an NMR determination step that determines, by a binary search, an NMR that does not exceed a target rate;

a scale factor determination step that determines, for each scale factor band and by a binary search, the maximum scale factor that corresponds to the NMR that was determined in said NMR determination step, and a rate;

and an evaluation step that evaluates the difference between the rate on said NMR calculated based on a scale factor determined in said scale factor determination step and said target rate, and determines whether said NMR is the smallest NMR that that does not exceed the target rate;

wherein each time that an NMR candidate value is selected that acts as a candidate during the binary search for an NMR in said NMR determination step, in said scale factor determination step a scale factor is determined on said NMR candidate value;

wherein if it is determined in said evaluation step-that said NMR candidate value is the smallest NMR that does not exceed the target rate, said NMR candidate value is determined as the optimal NMR;

wherein if it is determined in said evaluation step that said NMR candidate value is not the smallest NMR that does not exceed the target rate, the steps from said NMR determination step to said evaluation step are repeated; and wherein said NMR determination step and said evaluation step constitute an outer loop, and the computer is caused to execute said scale factor determination step as an inner loop.

18. The computer-readable medium of claim 17, wherein said NMR determination step includes starting a binary search from an interval that is defined by a predicted NMR value and an NMR candidate value that is selected such that rates corresponding to the rates with respect to said predicted NMR value include said target rate between them.

19. The computer-readable medium of claim 18, wherein said scale factor determination step includes:

setting, for each scale factor band, the smallest scale factor among the scale factors whose absolute quantization value of frequency spectra does not exceed a previously established maximum value as a west scale factor; and calculating, as an east scale factor, the smallest scale factor for which the quantization values of frequency spectra are all zero, wherein a binary search is started for the maximum scale factor corresponding to the NMR candidate value that was selected by said NMR determination step, from an interval that is demarked by said west scale factor and said east scale factor.

20. The computer-readable medium of claim 19, wherein said scale factor determination step includes:

calculating the maximum and minimum NMRs based upon the west scale factor and the east scale factor that were calculated by said scale factor determination step;

determining said west scale factor as a scale factor with respect to said NMR candidate value if said NMR candidate value is less than the minimum NMR; and determining said east scale factor as a scale factor with respect to said NMR candidate value if said NMR candidate value is greater than the maximum NMR.

* * * * *